United States Patent [19]

Williams et al.

[11] Patent Number: 4,909,392

[45] Date of Patent: Mar. 20, 1990

[54] LIQUID CONTAINER

[75] Inventors: James B. Williams; James R. Williams, both of Fort Worth, Tex.

[73] Assignee: Aspen, Inc., Arlington, Tex.

[21] Appl. No.: 239,461

[22] Filed: Sep. 1, 1988

[51] Int. Cl.[4] ..... B65D 1/16; B65D 21/02

[52] U.S. Cl. ..... 206/509; 220/94 A; 222/466

[58] Field of Search ..... 220/94 A; 206/509; 222/466, 465.1; 215/10

[56] References Cited

U.S. PATENT DOCUMENTS

| | | | |
|---|---|---|---|
| 1,621,252 | 3/1927 | Hillyard | 222/465.1 X |
| 1,627,851 | 5/1927 | Kroll | 222/466 X |
| 1,649,223 | 11/1927 | Grant | 222/465.1 X |
| 1,802,509 | 4/1931 | Hillyard | 222/465.1 X |
| 1,825,670 | 10/1931 | Kuck | 222/465.1 X |
| 3,308,997 | 3/1967 | Kelly | 220/94 A |
| 3,474,843 | 10/1969 | Maris | 220/303 X |
| 4,656,840 | 4/1987 | Loofbourrow et al. | 215/10 X |

*Primary Examiner*—Stephen M. Hepperle

*Attorney, Agent, or Firm*—James E. Bradley

[57] ABSTRACT

A liquid container is shown having improved pouring and stacking qualities. The container has a body with a cylindrical exterior and opposed end walls. A bottom support extends tangentially from a first point on the cylindrical exterior surface and includes a planar portion which forms a base for supporting the body in an upright position. A transport handle extends from a second point on the cylindrical exterior surface for use in rotating the container between the upright position and the pouring position in which the cylindrical exterior surface rolls over the surrounding support surface during use.

6 Claims, 2 Drawing Sheets

LIQUID CONTAINER

BACKGROUND OF THE INVENTION

1. Field of the Invention

The present invention relates to liquid storage containers and particularly to a container having improved pouring and stacking qualities.

2. Description of the Prior Art

A variety of metal and plastic containers are known for storing solids and liquids. A need exists, nevertheless, for an improved container with improved pouring and stacking properties. A need exists for such a container with properties which facilitate pouring without spilling and with a minimum of effort. A need also exist for such a container which allows multiple units to be stacked in a small space for display, storage, or transit.

SUMMARY OF THE INVENTION

The liquid container of the invention features a drum-shaped body having a cylindrical exterior surface which is symmetrical about a central axis and having opposed end walls which are arranged transverse to the central axis. The cylindrical exterior surface and opposed end walls together define a normally closed interior for the container. A bottom support extends tangentially from a first point on the cylindrical exterior surface. The bottom support includes a handle portion and a planar portion which forms a base for supporting the body in an upright position on a surrounding support surface with the central axis of the drum-shaped body being generally parallel to the plane of the surrounding support surface. A transport handle extends from a second point on the cylindrical exterior surface for transporting the container and for use, along with the handle portion of the bottom support, in rotating the container about the central axis between the upright position and a pouring position in which the cylindrical exterior surface rolls over the surrounding support surface.

The transport handle includes a hollow interior which communicates with the container interior. The transport handle is also provided with a pour spout for pouring liquid, the liquid passing from the container interior, through the hollow interior of the handle, and out the pour spout. A selected one of the opposed end walls of the drum-shaped body is recessed with respect to the cylindrical exterior. The other selected end wall protrudes outwardly with respect to the cylindrical exterior so that a pair of liquid containers can be stacked by mating the respected end walls thereof in tongue and groove fashion.

Additional objects, features and advantages will be apparent in the written description which follows.

DETAILED DESCRIPTION OF THE INVENTION

Figure 1:
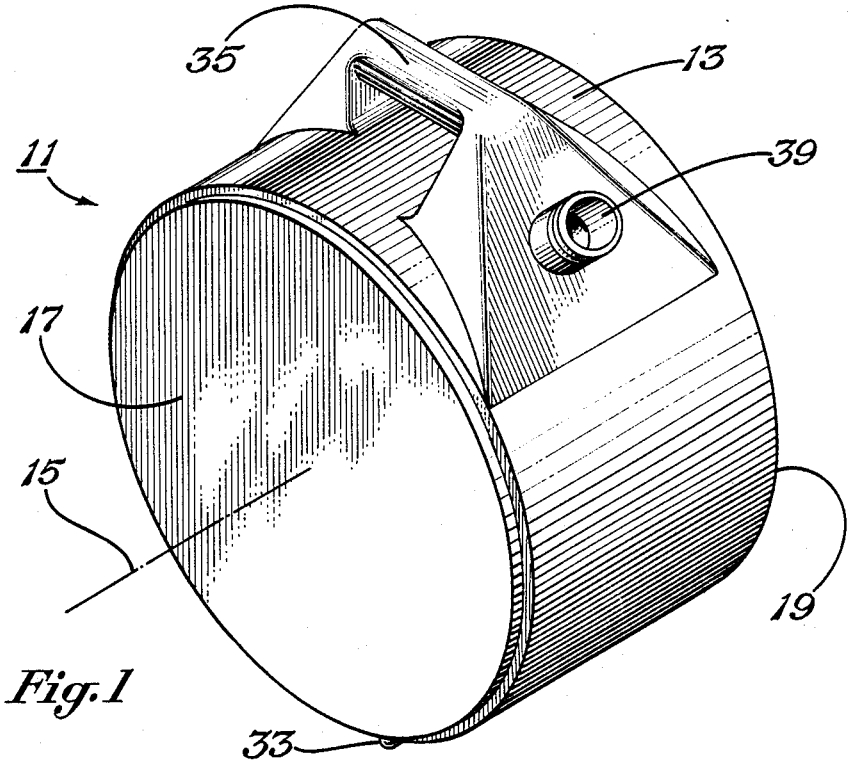
FIG. 1 is a front, perspective view of the liquid container of the invention showing the pour spout thereof.

FIG. 1 shows a container of the invention designated generally as 11. The container 11 includes a body having a cylindrical exterior surface 13 which is symmetrical about a central axis 15. The body also has opposed end walls 17, 19 which are arranged transverse to the central axis 15. The cylindrical exterior surface 13 and the opposed end walls 17, 19 together define a normally closed interior 21 (FIG. 5) for the container 11.

Figure 2:
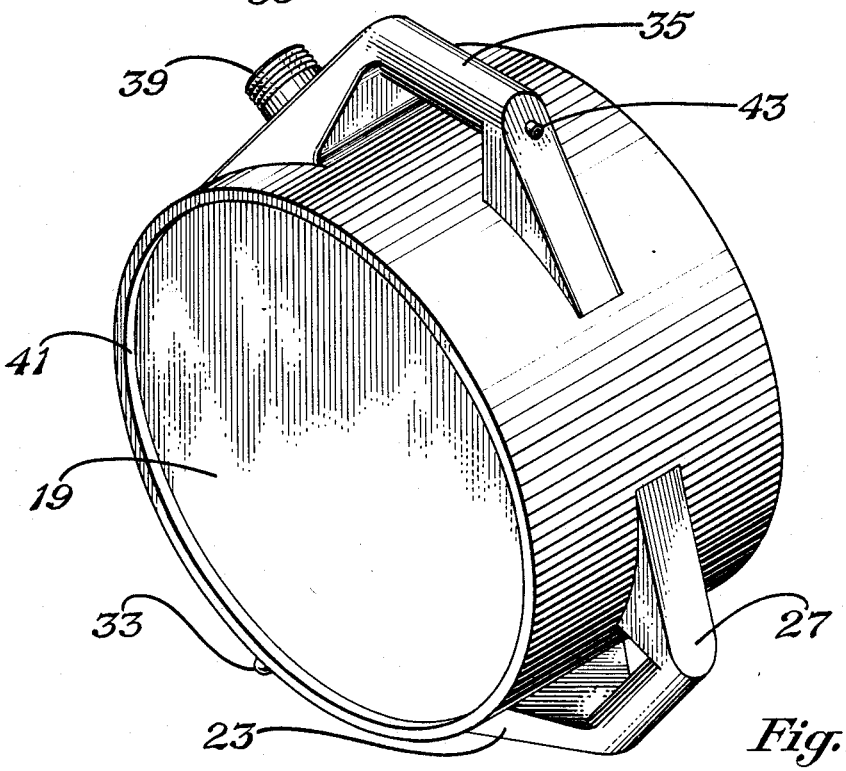
FIG. 2 is a rear, perspective view of the container of FIG. 1 showing the handles.
Figure 3:
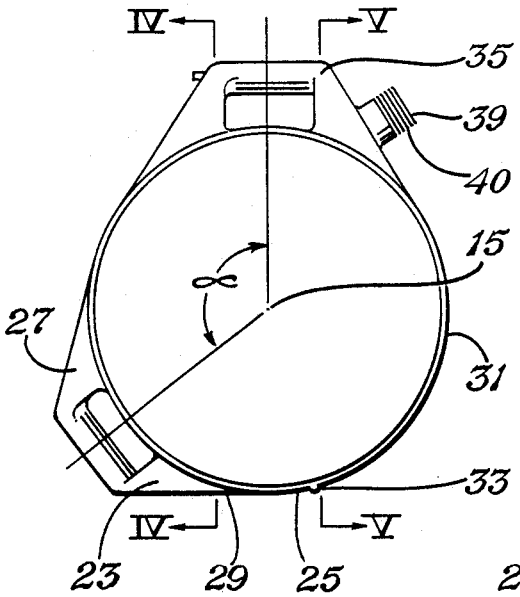
FIG. 3 is a side, plan view of the container of FIG. 1.

As shown in FIGS. 2 and 3, support means, including bottom support 23 extend tangentially from a first point (25 in FIG. 3) on the cylindrcal exterior surface 13. The bottom support 23 includes a handle portion 27 and a planar portion 29 which forms a base for supporting the body in an upright position on a support surface such as the ground or floor (not shown). In the upright position, the central axis 15 of the drum-shaped body is generally parallel to plane of the surrounding support surface. As best shown in FIG. 3, the planar portion 29 merges with the container cylindrical exterior surface 13 as the surface tangentially approaches point 25 to thereby define an arc-shaped rolling surface 31 on the container exterior. A protruberance, such as rib 33, extends across the cylindrical exterior surface adjacent point 25 to assist in holding the container in the upright position shown in FIG. 3.

The container also has transport means, such a transport handle 35 which extends from a second point on the cylindrical exterior surface displaced counterclockwise from the planar portion 29 of the container. The mid-point of transport handle 35 is displaced counterclockwise through an angle alpha from the mid-point of handle portion 23 approximately 130 degrees with respect to the central axis 15. The transport handle 35 is used, along with the handle portion 27 of the bottom support in rotating the container about the central axis 15 between the upright position and a pouring position in which the cylindrical exterior surface rolls over the surrounding support surface. Preferably, the transport handle 35 includes a hollow interior 37 which communicates with the container interior 21. The transport handle 35 is also provided with a pour spout 39 for pouring liquid. The pour spout is threded, as at 40, to receive a suitable cap. The liquid passes from the container interior 21, through the hollow interior 37 of the handle and out the pour spout 39.

Figure 5:
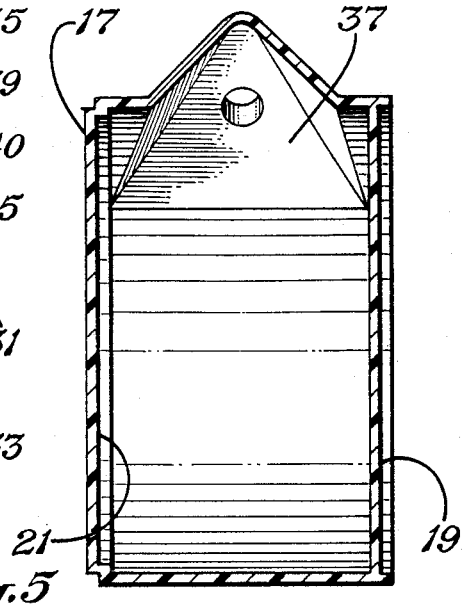
FIG. 5 is a partial, cross-sectional view of the container of FIG. 3 taken along the lines V—V.
Figure 4:
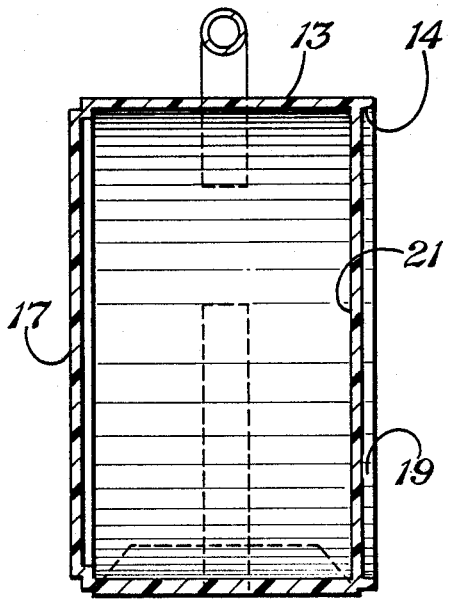
FIG. 4 is a cross-sectional view of the container of FIG. 3 taken along the lines IV—IV.
Figure 6:
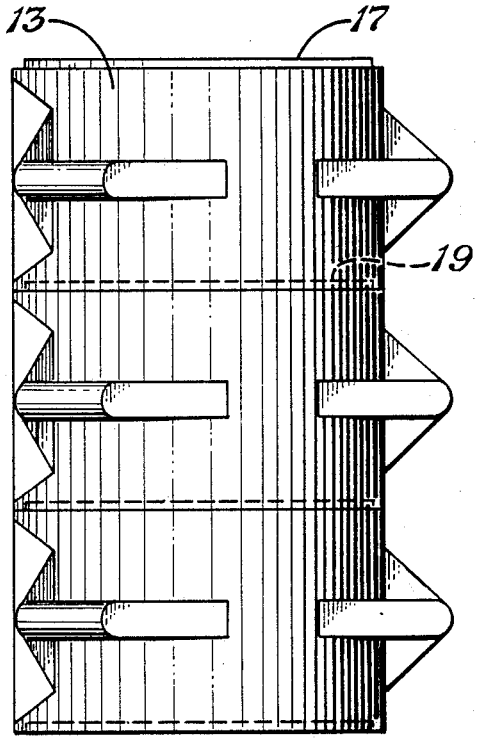
FIG. 6 is a side, plan view of three of the containers of the invention in the flat, stacked position.

As best seen in FIGS. 4 and 5, a selected one 19 of the opposed end walls of the drum-shaped body is recessed with respect to the cylindrical exterior 13, thereby forming a cylindrical recess and an internal lip 41. The other selected end wall 17 protrudes outwardly with respect to the cylindrical exterior 13 to form a raised disk so that a pair of liquid containers can be stacked by mating the respective end walls 17, 19 thereof in tongue and groove fashion (FIG. 6).

As shown in FIG. 2, the transport handle 35 can also be provided with a vent port and plug 43 which communicates with the container interior 21 by means of the hollow handle interior 37.

The container 11 can be constructed of any convenient material including metal and synethetic materials. Preferably the container is constructed of molded polyethylene.

In use, the container can be filled through the pour spout 39 with any liquid, including gasoline or oil. The container normally rests in an upright position as shown in FIG. 3 with the central axis 15 being generally parallel to the ground or floor which supports the container. In order to dispense liquid from the pour spout 39, the user grasps the transport handle 35 and handle portion 27 of the bottom support 23 and rotates the container about the axis 15 with the pour spout 39 moving in the clockwise direction. This causes the container to ride over the rib 33 with the arc-shaped rolling surface 31 being rolled over the surrounding support surface until liquid can be poured from the pour spout 39.

An invention has been provided with several advantages. The liquid container of the invention is simple in design and economical to manufacture. The transport handle and handle portion of the base support are axially displaced about the central axis 15 of hte container to facilitate the pouring action. The axially displaced handles also provide convenient points for grasping the container during transport. The opposed end walls of the container mate in tongue and groove fashion to provide an interfit when the cans are laid in the flat, stacked position. A plurality of containers can be stacked in a small area for display, storage or transport.

While the invention has been shown in only one of its forms, it is not thus limited but is susceptible to various changes and modifications without departing from the spirit thereof.

We claim:

1. A liquid container, comprising:

a drum-shaped body having a cylindrical exterior surface which is symmetrical about a central axis and having opposed end walls arranged transverse to the central axis, the cylindrical exterior surface and opposed end walls together defining a normally closed interior for the container;

a bottom support extending tangentially from a first point on the cylindrical exterior surface, the bottom support including a handle portion and a planar portion which forms a base for supporting the body in an upright position on a support surface with the central axis of the drum-shaped body being generally parallel to the plane of the surrounding support surface;

a transport handle extending from a second point on the cylindrical exterior surface for transporting the container and for use, along with the handle portion of the bottom support, in rotating the container about the central axis between the upright position and a pouring position in which the cylindrical exterior surface rolls over the surrounding support surface; and wherein the transport handle includes a hollow interior which communicates with the container interior, the transport handle also being provided with a pour spout for pouring liquid, the liquid passing from the container interior, through the hollow interior of the handle and out the pour spout.

2. A liquid container, comprising:

a drum-shaped body having a cylindrical exterior surface which is symmetrical about a central axis and having opposed end walls arranged transverse to the central axis, the cylindrical exterior surface and opposed end walls together defining a normally closed interior for the container;

a bottom support extending tangentially from a first point on the cylindrical exterior surface, the bottom support including a handle portion and a planar portion which forms a base for supporting the body in an upright position on a support surface with the central axis of the drum-shaped body being generally parallel to the plane of the surrounding support surface;

a transport handle extending from a second point on the cylindrical exterior surface for transporting the container and for use, along with the handle portion of the bottom support, in rotating the container about the central axis between the upright position and a pouring position in which the cylindrical exterior surface rolls over the surrounding support surface; and wherein said transport handle also includes a vent port which communicates with the container interior by means of the handle hollow interior.

3. A liquid container, comprising:

a drum-shaped body having a cylindrical exterior surface which is symmetrical about a central axis and having opposed end walls arranged transverse to the central axis, the cylindrical exterior surface and opposed end walls together defining a normally closed interior for the container;

a bottom support extending tangentially from a first point on the cylindrical exterior surface, the bottom support including an outer extent which forms a handle portion and an inner, planar portion which forms a base for supporting the body in an upright position on a support surface with the central axis of the drumshaped body being generally parallel to the plane of the surrounding support surface, the inner planar portion merging with the container cylindrical exterior surface to thereby define an arc-shaped rolling surface on the container exterior;

a transport handle extending from a second point on the cylindrical exterior surface for transporting the container and for use, along with the handle portion of the bottom support, in rotating the container about the central axis between the upright position and a pouring position in which the cylindrical exterior surface rolls over the surrounding support surface; and a protruberance located on the container cylindrical exterior proximate the point at which the inner planar portion of the bottom support merges with the container cylindrical exterior surface to form the arc-shaped rolling surface, the protruberance serving to retain the container in the upright position until the container is rotated about the central axis during pouring.

4. The liquid container of claim 3, wherein the transport handle includes a hollow interior which communicates with the container interior, the transport handle also being provided with a pour spout for pouring liquid, the liquid passing from the container interior, through the hollow interior of the handle and out the pour spout.

5. The liquid container of claim 4, wherein a selected one of the opposed end walls of the drum-shaped body is recessed with respect to the cylindrical exterior and wherein the other selected end wall protrudes outwardly with respect to the cylindrical exterior so that a pair of liquid containers can be stacked by mating the respective end walls thereof in tongue and groove fashion.

6. A method of dispensing liquid from a container, comprising the steps of:

providing a drum-shaped body having a cylindrical exterior surface which is symmetrical about a central axis and having opposed end walls arranged transverse to the central axis, the cylindrical exterior surface and opposed end walls together defining a normally closed interior for the container;

providing a bottom support extending tangentially from a first point on the cylindrical exterior surface, the bottom support including a handle portion and a planar portion which forms a base for supporting the body in an upright position on a support surface with the central axis of the drum-shaped body being generally parallel to the plane of the surrounding support surface;

providing a transport handle extending from a second point on the cylindrical exterior surface, the transport handle including a hollow interior which communicates with the container interior, the transport handle also being provided with a pour spout for pouring liquid;

moving the container between the upright position and a pouring position by grasping the transport handle and rotating the container body about the central axis with the cylindrical exterior surface rolling over the surrounding support surface, the liquid passing from the container interior, through the hollow interior of the handle and out the pour spout.

* * * * *